US005432581A

United States Patent [19]

Patton et al.

[11] Patent Number: 5,432,581

[45] Date of Patent: Jul. 11, 1995

[54] RACK AND A TANK FOR A PHOTOGRAPHIC PROCESSING APPARATUS

[75] Inventors: David L. Patton, Webster; Roger E. Bartell, Rochester; John H. Rosenburgh, Hilton; Ralph L. Piccinino, Jr., Rush, all of N.Y.

[73] Assignee: Eastman Kodak Company, Rochester, N.Y.

[21] Appl. No.: 844,815

[22] Filed: Mar. 2, 1992

[51] Int. Cl.[6] ..... G03D 3/08

[52] U.S. Cl. ..... 354/299; 354/321; 354/331

[58] Field of Search ..... 354/319–324, 354/339, 299, 331, 336, 298

[56] References Cited

U.S. PATENT DOCUMENTS

| | | | |
|---|---|---|---|
| 717,021 | 12/1902 | Pollak | 354/319 |
| 1,867,172 | 7/1932 | Ranger | 354/328 |
| 3,025,779 | 3/1962 | Russell et al. | 354/339 |
| 3,362,315 | 1/1968 | Buechner | 354/331 |
| 3,598,037 | 8/1971 | Houston, Sr. | 354/319 |
| 3,601,029 | 8/1971 | Needleman | 354/331 X |
| 4,100,560 | 7/1978 | Schochet | 354/333 X |
| 4,423,947 | 1/1984 | Jelinek et al. | 354/320 |
| 4,439,033 | 3/1984 | Freeman | 354/322 X |
| 4,512,645 | 4/1985 | Englehard et al. | 354/324 |
| 4,534,635 | 8/1985 | Johnston et al. | 354/322 |
| 4,613,223 | 9/1986 | Cherry et al. | 354/322 |
| 4,708,453 | 11/1987 | Fryda et al. | 354/320 |
| 4,745,423 | 5/1988 | Uchida | 354/320 |
| 4,758,858 | 7/1988 | Blackman et al. | 354/321 |
| 4,922,276 | 5/1990 | Lamprecht et al. | 354/299 |
| 4,926,211 | 5/1990 | Ozawa | 354/319 X |
| 4,980,714 | 12/1990 | Nakamura et al. | 354/322 |
| 4,987,438 | 1/1991 | Goto et al. | 354/324 X |
| 5,043,756 | 8/1991 | Takabayashi et al. | 354/320 |

FOREIGN PATENT DOCUMENTS

| | | | |
|---|---|---|---|
| 0222583 | 5/1987 | European Pat. Off. | G03D 3/10 |
| 549974 | 2/1923 | France . | |
| 2622708 | 2/1987 | France . | |
| 2047864 | 4/1972 | Germany . | |
| 56-159645 | 12/1981 | Japan | 354/319 |
| 59-38743 | 3/1984 | Japan . | |
| 62-67545 | 3/1987 | Japan | 354/320 |
| 027040 | 1/1990 | Japan . | |
| 2-67553 | 3/1990 | Japan | 354/320 |
| 2067552 | 3/1990 | Japan . | |
| 2067553 | 3/1990 | Japan . | |
| 889384 | 2/1962 | United Kingdom . | |
| 1028216 | 5/1966 | United Kingdom . | |
| 90128604 | 6/1990 | United Kingdom . | |
| 91140905 | 6/1991 | United Kingdom . | |

OTHER PUBLICATIONS

Jun. 1979 IBM Technical Disclosure.

*Primary Examiner*—D. Rutledge
*Attorney, Agent, or Firm*—Frank Pincelli

[57] ABSTRACT

An apparatus for processing photosensitive materials, which comprises: a tank through which a processing solution flows; a rack having integral means to facilitate its insertion and removal from the tank, the rack and the tank are relatively dimensioned so that a small volume for holding processing solution and photosensitive material is formed between the rack and the tank; means for circulating the processing solution through the small volume; and means coupled to the rack for moving the photosensitive material through the small volume.

21 Claims, 5 Drawing Sheets

RACK AND A TANK FOR A PHOTOGRAPHIC PROCESSING APPARATUS

CROSS REFERENCE TO RELATED APPLICATIONS

Reference is made to commonly assigned copending patent applications: Ser. No. 844,820 entitled "A DRIVING MECHANISM FOR A PHOTOGRAPHIC PROCESSING APPARATUS" filed herewith in the names of Ralph L. Piccinino, Jr., David L. Patton, Roger E. Bartell, Anthony Earle, and John Rosenburgh, Ser. No. 844,343 entitled "ANTI-WEB ADHERING CONTOUR SURFACE FOR A PHOTOGRAPHIC PROCESSING APPARATUS" filed herewith in the names of Roger E. Bartell, Ralph L. Piccinino, Jr., John H. Rosenburgh, Anthony Earle, and David L. Patton, Ser. No. 844,355 entitled "A SLOT IMPINGEMENT FOR A PHOTOGRAPHIC PROCESSING APPARATUS" filed herewith in the names of John Rosenburgh, David L. Patton, Ralph L. Piccinino, Jr., and Anthony Earle, and Ser. No. 844,806 entitled "RECIRCULATION, REPLENISHMENT, REFRESH, RECHARGE AND BACKFLUSH FOR A PHOTOGRAPHIC PROCESSING APPARATUS" filed herewith in the names of Roger E. Bartell, David L. Patton, John Rosenburgh, and Ralph L. Piccinino, Jr.

BACKGROUND OF THE INVENTION

1. Field of the Invention

The invention relates to the field of photography, and particularly to a photosensitive material processing apparatus.

2. Description of the Prior Art

The processing of photographic film involves a series of steps such as developing, bleaching, fixing, washing, and drying. These steps lend themselves to mechanization by conveying a continuous web of film or cut sheets of film or photographic paper sequentially through a series of stations or tanks, each one containing a different processing liquid appropriate to the process step at that station.

There are various sizes of photographic film processing apparatus, i.e., large photofinishing apparatus and microlabs. A large photofinishing apparatus utilizes tanks that contain approximately 100 liters of each processing solution. A small photofinishing apparatus or microlab utilizes tanks that may contain less than 10 liters of processing solution.

The chemicals contained in the photographic solution: cost money to purchase; change in activity and leach out or season during the photographic process; and after the chemicals are used the chemicals must be disposed of in an environmentally safe manner. Thus, it is important in all sizes of photofinishing apparatus to reduce the volume of processing solution. The prior art suggest various types of replenishing systems that add or subtract specific chemicals to the photographic solution to maintain a consistency of photographic characteristics in the material developed. It is possible to maintain reasonable consistency of photographic characteristics only for a certain period of replenishment. After a photographic solution has been used a given number of times, the solution is discarded and a new photographic solution is added to the tank.

Activity degradation due to instability of the chemistry, or chemical contamination, after the components of the photographic solution are mixed together causes one to discard the photographic solution in smaller volume tanks more frequently than larger volume tanks. Some of the steps in the photographic process utilize photographic solutions that contain chemicals that are unstable, i.e., they have a short process life. Thus, photographic solutions in tanks that contain unstable chemicals are discarded more frequently than photographic solutions in tanks that contain stable chemicals.

The prior art suggest that if the volume of the various tanks contained within various sizes of photographic processing apparatus were reduced the same amount of film or photographic paper may be processed, while reducing the volume of photographic solution that was used and subsequently discarded. One of the problems in using smaller volume tanks is that the inner and outer sections of the tank typically are fixed and not separable. Another problem in using low volume tanks is that the material being processed typically has a tendency to jam. Hence, it was difficult and time-consuming to separate the rack from the tank for cleaning and maintenance purposes.

SUMMARY OF THE INVENTION

This invention overcomes the disadvantages of the prior art by providing a low volume photographic material processing apparatus that utilizes photographic tanks having an inner rack section and an outer tank section that are easily separated. The processing apparatus will contain a smaller volume of the same photographic solution that was previously used in regular-sized processing tanks. In fact, in some instances, the volume of photographic solution utilized in regular-sized tanks may be reduced by as much as 90%. Hence, the apparatus of this invention is capable of reducing the volume of photographic solution that is used and subsequently discarded by photographic processing apparatus while permitting the inner rack section of the tank to be easily separated from the outer tank.

The foregoing is accomplished by providing an apparatus for processing photosensitive materials, which comprises: a tank through which a processing solution flows; a rack having integral means to facilitate its insertion and removal from the tank, the rack and the tank are relatively dimensioned so that a small volume for holding processing solution and photosensitive material is formed between the rack and the tank; means for circulating the processing solution through the small volume; and means coupled to the rack for moving the photosensitive material through the small volume.

DESCRIPTION OF THE PREFERRED EMBODIMENT

Figure 1:
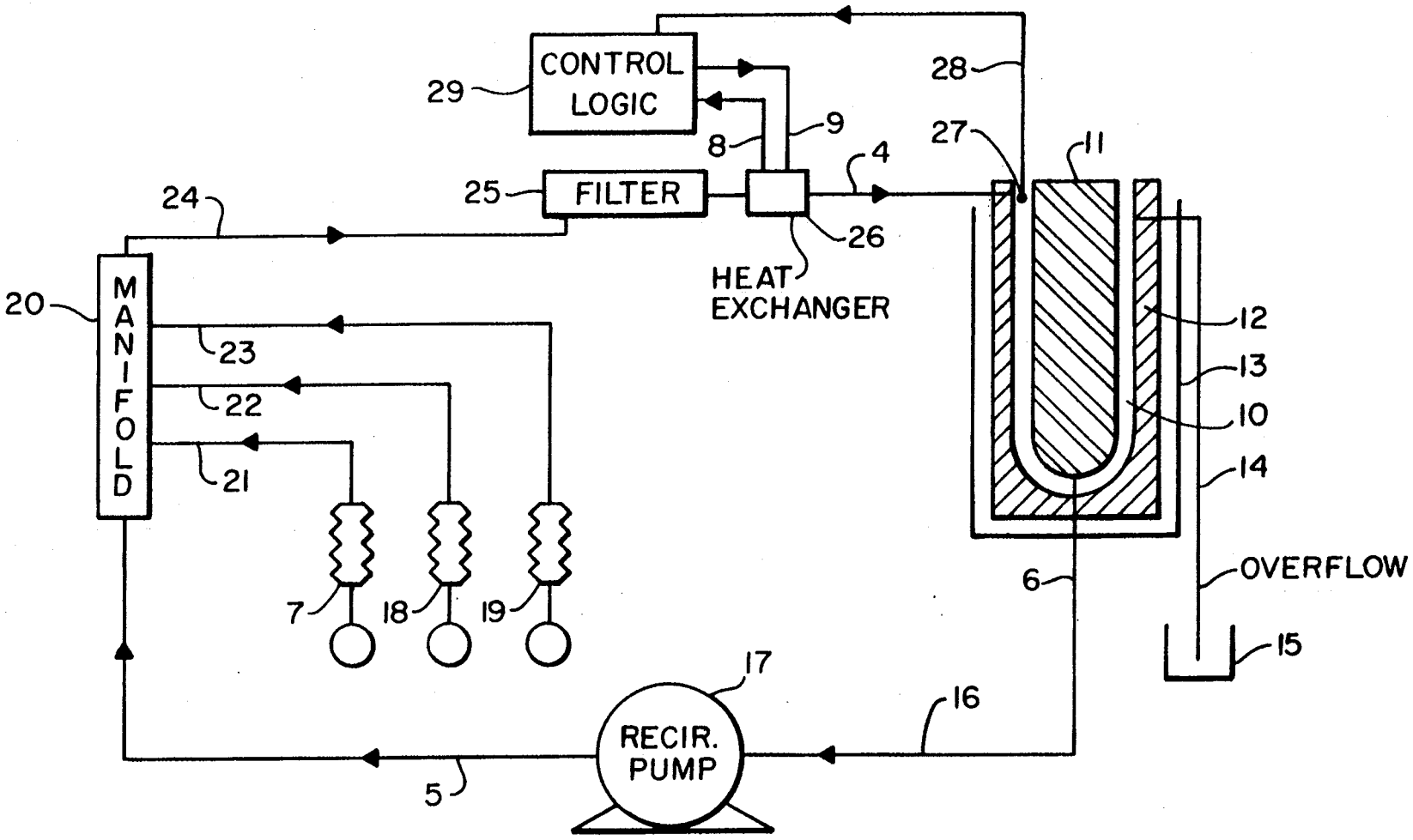
FIG. 1 is a schematic drawing of the apparatus of this invention.

Referring now to the drawings in detail, and more particularly to FIG. 1, the reference character 11 represents a rack 11, which may be easily inserted and removed from tank 12. Rack 11 and tank 12 form a low volume photosensitive material processing vessel 13.

When rack 11 is inserted in tank 12, a space 10 is formed. Rack 11 and tank 12 are designed in a manner to minimize the volume of space 10. The outlet 6 of vessel 13 is connected to recirculating pump 17 via conduit 16. Recirculating pump 17 is connected to manifold 20 via conduit 5 and manifold 20 is coupled to filter 25 via conduit 24. Filter 25 is connected to heat exchanger 26 and heat exchanger 26 is connected to control logic 29 via wire 9. Control logic 29 is connected to heat exchanger 26 via wire 8 and sensor 27 is connected to control logic 29 via wire 28. Metering pumps 7, 18 and 19 are respectively connected to manifold 20 via conduits 21, 22 and 23, The photographic processing chemicals that comprise the photographic solution are placed in metering pumps 7, 18 and 19. Pumps 7, 18 and 19 are used to place the correct amount of chemicals in manifold 20. Manifold 20 introduces the photographic processing solution into conduit 24.

The photographic processing solution flows into filter 25 via conduit 24. Filter 25 removes particulate matter and dirt that may be contained in the photographic processing solution. After the photographic processing solution has been filtered, the solution enters heat exchanger 26.

Sensor 27 senses the temperature of the solution and transmits the temperature of the solution to control logic 29 via wire 28. For example, control logic 29 is the series CN 310 solid state temperature controller manufactured by Omega Engineering, Inc. of 1 Omega Drive, Stamford, Conn. 06907. Logic 29 compares the solution temperature sensed by sensor 27 and the temperature that exchanger 26 transmitted to logic 29 via wire 8. Logic 29 will inform exchanger 26 to add or remove heat from the solution. Thus, logic 29 and heat exchanger 26 modify the temperature of the solution and maintain the solution temperature at the desired level.

At this point the solution enters vessel 13 via inlet 4. When vessel 13 contains too much solution the excess solution will be removed by drain 14 and flow into reservoir 15. The remaining solution will circulate through space 10 and reach outlet line 6. Thereupon, the solution will pass from outlet line 6 to conduit line 16 to recirculation pump 17. The photographic solution contained in the apparatus of this invention, when exposed to the photosensitive material, will reach a seasoned state more rapidly than prior art systems, because the volume of the photographic processing solution is less.

Figure 2:
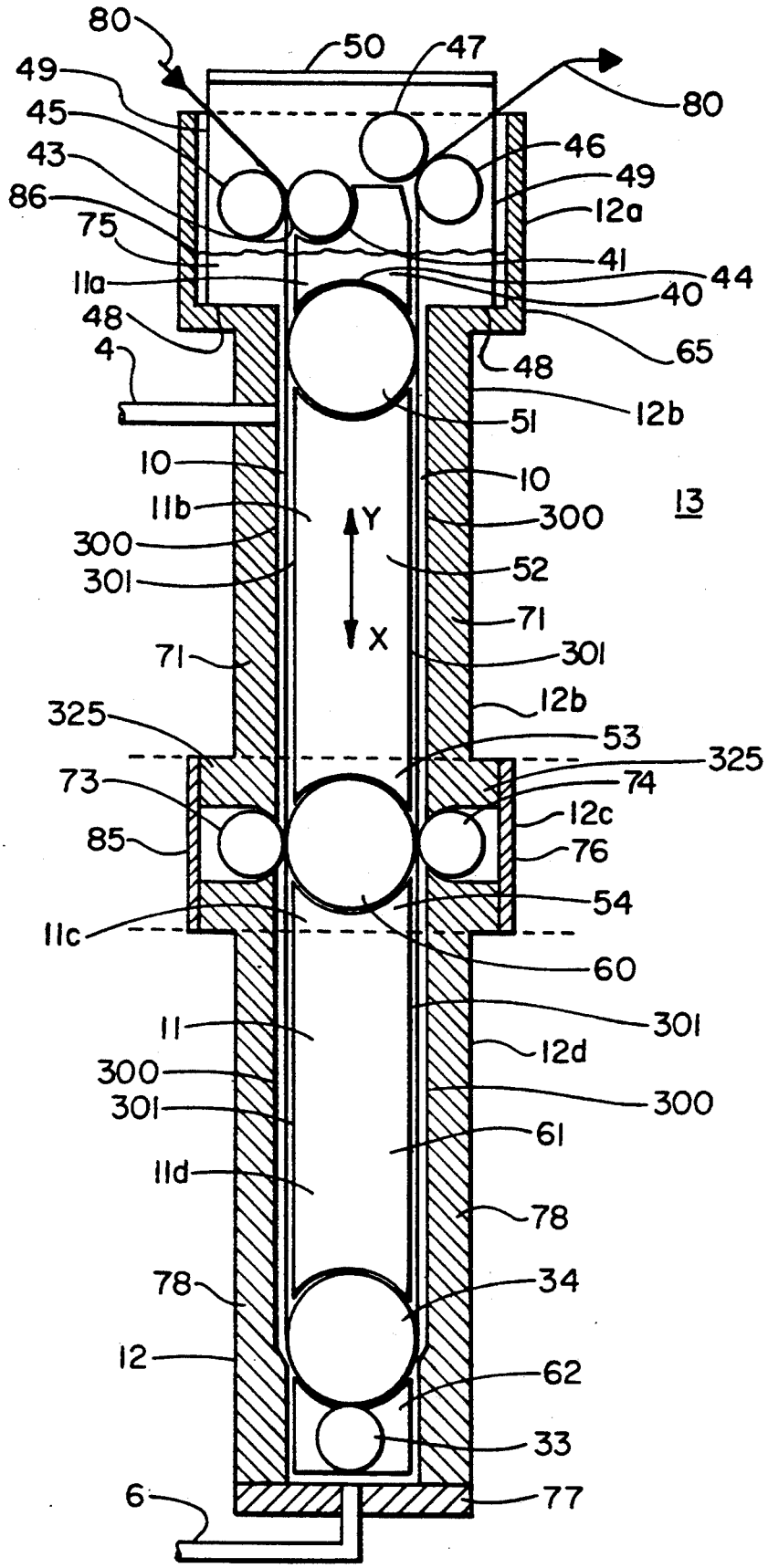
FIG. 2 is a schematic drawing showing rack 11 and tank 12 of FIG. 1 in greater detail.

FIG. 2 is a schematic diagram showing rack 11 positioned within tank 12. Handle section **11*a* of rack 11 includes a panel 40. Panel 40 has a cutout section 41 which allows driven roller 43 of rack section 11*a* to rotate in the vicinity of panel 40. Panel 40 also has a cutout section 44 which allows driving roller 51 of rack section 11*b* to rotate in the vicinity of panel 40. Driving roller 45 engages roller 43. Driving roller 46 drives driven roller 47. Rollers 46 and 47 are attached to section 11*a*. Bottom plate 48 is connected to panel 40 and side plates 49. Handle 50 is connected to side plates 49 so that an individual may be able to grasp handle 50 and move rack 11 in the direction indicated by arrow X, thereby inserting rack 11 into tank 12. This is the position shown in FIG. 2. Handle 50 may also be grasped and moved in the direction indicated by arrow Y to remove rack 11 from tank 12**.

Top section **11*b* of rack 11 includes panel 52 and driving roller 51 and center section 11*c* of rack 11 includes panels 53 and 54 and driving roller 60. Bottom section 11*d* of rack 11 includes panels 61 and 62, driving roller 34 and driven roller 33**.

Tank section **12*a* includes a housing section 65. Tank section 12*b* includes sides 71. Tank section 12*c* includes driven rollers 73 and 74 and sides 325. Roller 73 is connected to plate 85 and driven roller 74 is connected to plate 76. Plates 85 and 76 are connected to sides 325. Bottom section 12*d* of tank 12 includes bottom panel 77 and sides 78. Outlet conduit 6 passes through panel 77 and inlet conduit 4 passes through side 71**.

Photosensitive material 80 may be a continuous web or cut sheets of film or photographic paper. The emulsion side of material 80 may face either rack 11 or tank 12. Material 80 passes in space 10 between rollers 45 and 43, roller 51 and side 71, rollers 73 and 60, rollers 34 and 33, rollers 60 and 74, roller 51 and side 71 and between rollers 46 and 47. Photographic processing solution 75 reaches a level 86 within tank 12. Photographic solution 75 will be contained between level 86, space 10 and photosensitive material 80. Thus, a small volume of photographic solution 75 will be on both sides of photosensitive material 80 between rack 11 and tank 12.

Rack 11 and tank 12 respectively comprise: handle sections **11*a* and 12*a*; top sections 11*b* and 12*b*; center sections 11*c* and 12*c*; and bottom sections 11*d* and 12*d***.

Tank 12 and rack 11 respectively have textured surfaces 300 and 301. The manner in which surfaces 300 and 301 function will be more fully set forth in the description of FIG. 5 and FIG. 6.

The length of rack 11 and tank 12 may be adjusted for different processing steps in the photographic process. If a vessel shorter than vessel 13 of FIG. 2 is required, center rack section **11*c* and center tank section 12*c* may be respectively deleted from rack 11 and tank 12. If a longer vessel than vessel 13 of FIG. 2 is required, one or more top sections 11*b* and 12*b* and one or more center sections 11*c* and 12*c* may be respectively connected between present sections 11*c* and 12*c* and present sections 11*d* and 12*d***.

Figure 3:
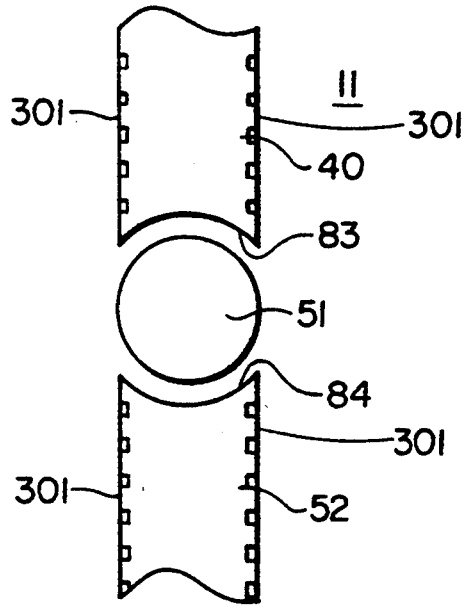
FIG. 3 is a drawing of a side view of driving roller 51 of FIG. 2.

FIG. 3 is a side view of roller 51 and textured surface 301 of rack 11. Rollers 60 and 34 are connected in a manner similar to the connection of roller 51 of FIG. 3.

Panels 40 and 52 of rack 11 respectively have curved portions 83 and 84. Curves 83 and 84 are shaped so that they will match the curvature of the outer surface of roller 51 and minimize the volume of solution 75 that will be contained between roller 51 and portions 83 and 84. Thus, the least amount of solution 75 is used to fill the voids around roller 51.

Figure 4:
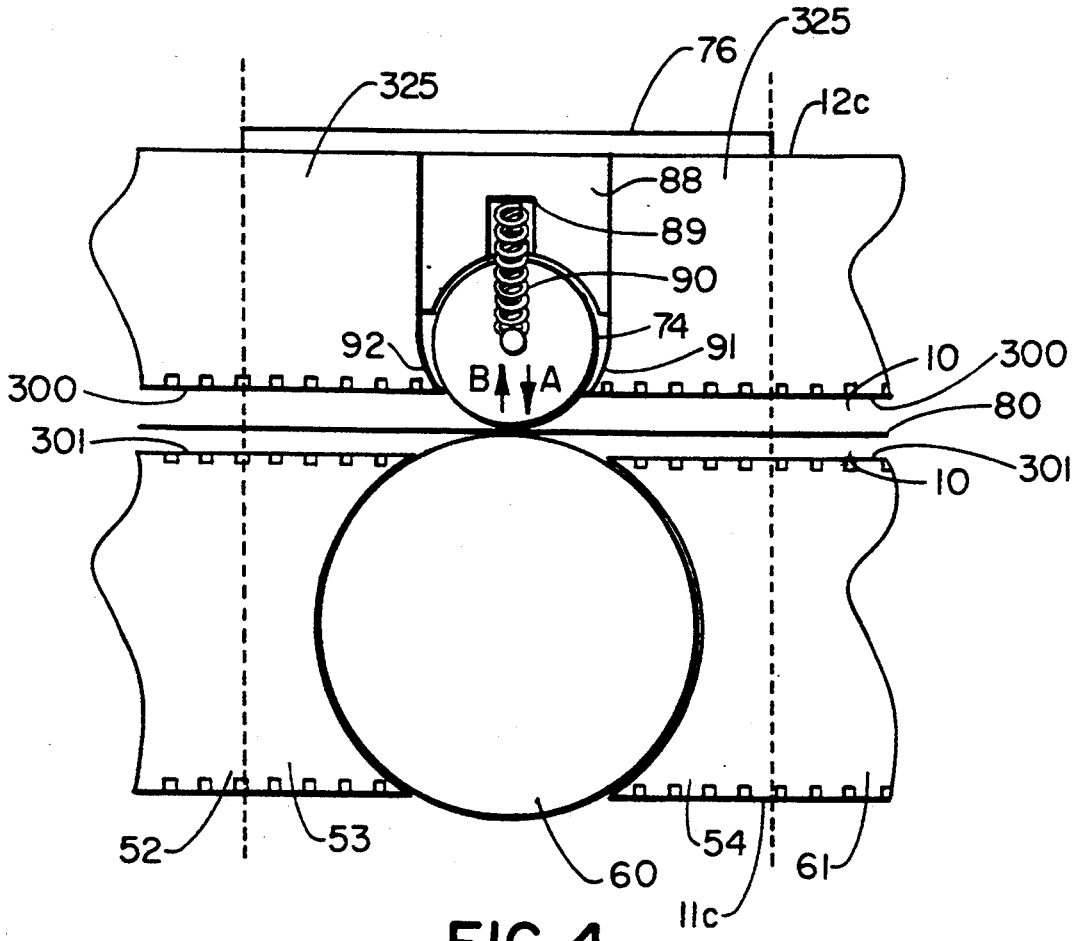
FIG. 4 is a drawing of a side view of driven roller 74 of FIG. 2.

FIG. 4 is a side view of roller 74 and roller 60 respectively of tank section **12*c* and rack section 11*c* of FIG. 2. Panel 53 and panel 54 with textured surface 301 are shaped so that they will match the curvature of the outer surface of roller 60 and minimize the volume of solution 75 that will be contained between the shaped portions of panels 53 and 54 and roller 60. Panel 52 with textured surface 301 butts against panel 53 and panel 61 with textured surface 301 butts against panel 54. Roller 73 of FIG. 2 is connected in the same manner as roller 74. Retainer 88 has a notch 89. One end of spring 90 is connected to notch 89 and the other end of spring 90 is connected to the hub of roller 74. One end of plate 91 is connected to retainer 88 and the other end of plate 91 is connected to textured surface 300. One end of plate 92 is connected to retainer 88 and the other end of plate 92 is connected to textured surface 300. Plates 91 and 92 are connected to retainer 88 and surface 300 in a manner to minimize the amount of surface contact roller 74 has with space 10. Retainer 88 is connected to back plate 76 by any known fastening means, i.e., bolts, screws, etc. Plate 76 is connected to side 325 (FIG. 2) of tank section 12***c* to minimize the volume of solution 75 that exists in the voids between the above surfaces, plates, rollers and tank. Photosensitive material 80 passes between rollers 60 and 74 so that driving roller 60 may move photosensitive material 80 in space 10 between textured surfaces 300 and 301. Roller 74 is spring loaded towards space 10 so that roller 74 may be compressed out of the way when rack 11 is inserted in tank 12.

Figure 4A:
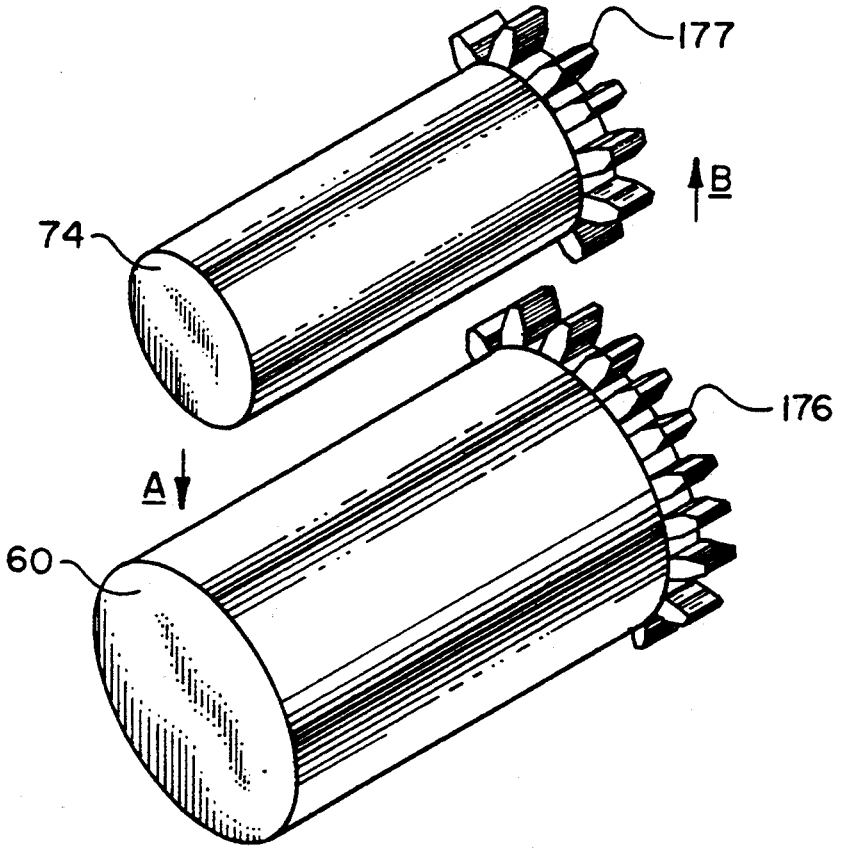
FIG. 4A is a drawing showing the gears of rollers 60 and 74.

FIG. 4A depicts gears 176 and 177 attached respectively to rollers 60 and 74 in such a manner that when roller 74 engages the surface of roller 60 gear 177 engages gear 176 so that gear 176 drives gear 177. When rack 11 is properly seated in tank 12, roller 74 will move in the direction shown by arrow A until it engages driving roller 60 and gears 176 and 177 will mesh. When rack 11 is removed from tank 12 roller 74 will move in the direction shown by arrow B compressing out of the way until rack 11 is removed from tank 12. At this juncture roller 74 will move in the direction shown by arrow A.

Figure 5:
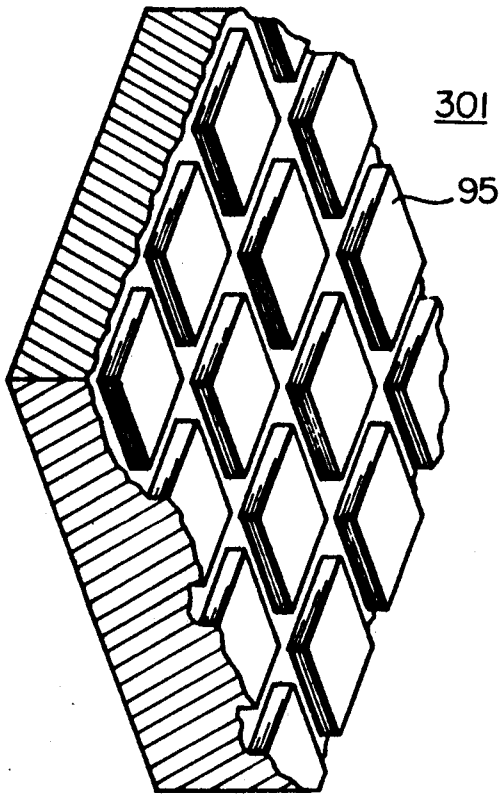
FIG. 5 is a perspective drawing of textured fluid bearing surface 301 which is affixed to rack 11 of FIG. 2.

FIG. 5 is a perspective drawing of textured fluid-bearing surface 301 which is affixed to rack 11 of FIG. 2. Textured surface 301 is textured by any known process, e.g., knurling, molded, EDM electro-discharged machined or applied. Knurls 95 are shown on surface 301. The texturing improves the flow of solution 75 between the photosensitive material and the rack. This yields a bearing of fluid aiding photosensitive material transport through the rack arrangement. It also allows for improved circulation of solution 75 and makes it easier for particulate matter to escape direct and damaging contact with photosensitive material 80. Textured surface 301 provides space between rack 11 and space 10 to prevent particulate matter from scratching, abrading or pressure sensitizing photosensitive material 80.

Figure 6:
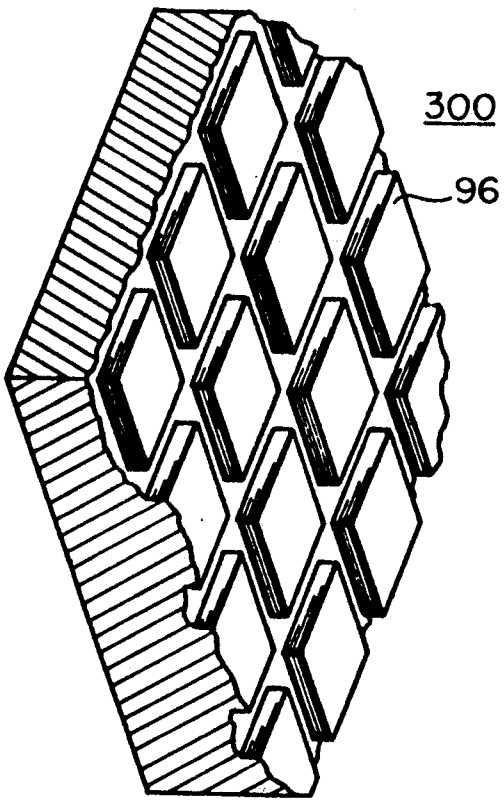
FIG. 6 is a perspective drawing of textured fluid bearing surface 300 which is affixed to tank 12 of FIG. 2.

FIG. 6 is a perspective drawing of textured fluid bearing surface 300 of tank 12. Textured surface 300 is textured by any known process, e.g., knurling, molded, EDM electro-discharged machined or applied. Knurls 96 are shown on surface 300. Texturing improves the flow of solution 75 between photosensitive material 80 and tank 12. This yields a bearing of fluid aiding photosensitive material transport through tank 12. It also allows for improved circulation of the solution 75 and makes it easier for particulate matter to escape direct and damaging contact with photosensitive material 80. Textured surface 300 provides space between tank 12 and space 10 to prevent particulate matter from scratching, abrading or pressure sensitizing photosensitive material 80.

The above specification describes a new and improved apparatus for processing photosensitive materials. It is realized that the above description may indicate to those skilled in the art additional ways in which the principles of this invention may be used without departing from the spirit. It is, therefore, intended that this invention be limited only by the scope of the appended claims.

What is claimed is:

1. An apparatus for processing photosensitive materials, which comprises:

a tank through which a processing solution flows;

a rack having integral means to facilitate its insertion and removal from said tank, said rack and said tank are relatively dimensioned so that a small volume for holding processing solution and photosensitive material is formed between said rack and said tank;

means for circulating the processing solution through the small volume; and a plurality of rollers coupled to said rack for moving the photosensitive material through the small volume, the rack having curved portions for receiving the rollers, said curved portions being shaped so as to substantially match the curvature of the outer surface of the roller so as to minimize the amount of processing solution between the roller and curved portions.

2. The apparatus claimed in claim 1, wherein a plurality of said racks and said tanks are interconnected to form a multi-step processor.

3. The apparatus claimed in claim 1, wherein said circulation means comprises:

a pump for recirculating the processing solution;

conduits connected to said pump, said rack and said tank for transporting the processing solution; and a filter connected to said conduits for removing particulate matter from the processing solution, wherein the processing solution contained in said pump, said conduits and said filter does not exceed the small volume for holding processing solution.

4. The apparatus claimed in claim 3, further including a heat exchanger that rapidly regulates the temperature of the processing solution.

5. The apparatus claimed in claim 3, further including:

a plurality of containers for holding processing solution components;

a plurality of metering pumps for metering specified amounts of chemicals contained in said containers; and a manifold coupled to said conduits and said metering pumps for dispensing additional processing solution to the small volume.

6. The apparatus claimed in claim 5, wherein said tank has an overflow conduit coupled to a reservoir to maintain a consistent processing solution level.

7. The apparatus claimed in claim 1, wherein said moving means comprises a plurality of rollers and one or more spring loaded rollers.

8. The apparatus claimed in claim 7, wherein said spring loaded rollers comprise:

a driving roller;

a driven roller connected to said driving roller; and a spring connected to said driven roller and a wall of said tank so that when said rack is inserted or removed from said tank said driven roller moves to provide space for said rack, and when said rack is inserted in said tank said driven roller moves to engage said driving roller so that the photosensitive material may be moved.

9. An apparatus for processing photosensitive materials, which comprises:

a tank through which a processing solution flows;

a rack having integral means to facilitate its insertion and removal from said tank, said rack and said tank are relatively dimensioned so that a small volume for holding processing solution and photosensitive material is formed between said rack and said tank; and means coupled to said rack for moving the photosensitive material through the small volume, wherein said rack, said tank and said moving means are capable of being used with an existing processor.

10. The apparatus claimed in claim 9, wherein the drive of the existing processor includes means for driving said moving means.

11. The apparatus claimed in claim 10, further including a temperature control for controlling the solution temperature of the apparatus.

12. An apparatus for processing photosensitive materials, which comprises:

a tank of a predetermined shape through which a processing solution flows;

a rack having integral means to facilitate its insertion and removal from said tank, said rack and said tank are relatively dimensioned so that said rack substantially fills said predetermined shape so as to define a substantially continuous narrow chamber for holding a small amount of processing solution through which the photosensitive material is passed;

means for circulating processing solution through the narrow chamber; and means coupled with said rack for moving the photosensitive materials through the narrow chamber.

13. The apparatus claimed in claim 12, wherein a plurality of said racks and said tanks are interconnected to form a multi-step processor.

14. The apparatus claimed in claim 12, wherein said circulation means comprises:

a pump for recirculating the processing solution;

conduits connected to said pump, said rack and said tank for transporting the processing solution; and a filter connected to said conduits for removing particulate matter from the processing solution, wherein the processing solution volume contained in said pump, said conduits and said filter does not exceed the small volume for holding processing solution.

15. The apparatus claimed in claim 14, further including a heat exchanger that rapidly regulates the temperature of the processing solution.

16. The apparatus claimed in claim 14, further including:

a plurality of containers for holding processing solution components;

a plurality of metering pumps for metering specified amounts of chemicals contained in said containers; and a manifold coupled to said conduits and said metering pumps for dispensing additional processing solution to the small volume.

17. The apparatus claimed in claim 16, wherein said tank has an overflow conduit coupled to a reservoir to maintain a consistent processing solution level.

18. The apparatus claimed in claim 12, wherein said moving means comprises a plurality of rollers and one or more spring loaded rollers.

19. The apparatus claimed in claim 18, wherein said spring loaded rollers comprise:

a driving roller;

a driven roller connected to said driving roller; and a spring connected to said driven roller and a wall of said tank so that when said rack is inserted or removed from said tank said driven roller moves to provide space for said rack, and when said rack is inserted in said tank said driven roller moves to engage said driving roller so that the photosensitive material may be moved.

20. The apparatus claimed in claim 19, wherein the drive of the existing processor includes means for driving said moving means.

21. The apparatus claimed in claim 20, further including a temperature control for controlling the solution temperature of the apparatus.

* * * * *